US011245980B2

(12) United States Patent
Korell et al.

(10) Patent No.: US 11,245,980 B2
(45) Date of Patent: Feb. 8, 2022

(54) CONNECTING DEVICE FOR LOUDSPEAKER BOXES, AND ARRANGEMENT OF LOUDSPEAKER BOXES HANGING BENEATH ONE ANOTHER

(71) Applicant: d&b audiotechnik GmbH & Co. KG, Backnang (DE)

(72) Inventors: Julius Korell, Backnang (DE); Nico Paul, Remseck am Neckar (DE)

(73) Assignee: d&b audiotechnik GmbH & Co. KG, Backnang (DE)

( * ) Notice: Subject to any disclaimer, the term of this patent is extended or adjusted under 35 U.S.C. 154(b) by 0 days.

(21) Appl. No.: 16/865,836

(22) Filed: May 4, 2020

(65) Prior Publication Data

US 2020/0351582 A1 Nov. 5, 2020

(30) Foreign Application Priority Data

May 2, 2019 (DE) ..... 10 2019 111 314.8

(51) Int. Cl.
*H04R 1/40* (2006.01)
*H04R 1/02* (2006.01)

(52) U.S. Cl.
CPC ..... *H04R 1/403* (2013.01); *H04R 1/02* (2013.01)

(58) Field of Classification Search
CPC ..... H04R 1/403; H04R 1/02
See application file for complete search history.

(56) References Cited

U.S. PATENT DOCUMENTS 5,602,366 A * 2/1997 Whelan ..... H04R 1/026 181/144
5,819,959 A * 10/1998 Martin ..... H04R 1/026 211/118
6,652,046 B2 * 11/2003 Christner ..... H04R 1/026 312/111
7,036,781 B1 * 5/2006 Bothe ..... H04R 1/026 16/235
8,170,263 B2 * 5/2012 Engebretson ..... H04R 1/30 381/386
8,590,666 B2 * 11/2013 Adamson ..... H04R 1/026 181/199
8,600,097 B2 * 12/2013 McGhee ..... H04R 1/02 381/386

(Continued)

FOREIGN PATENT DOCUMENTS

CN 207543274 U 6/2018
CN 207968777 U 10/2018

(Continued)

*Primary Examiner* — Oyesola C Ojo
(74) *Attorney, Agent, or Firm* — Cooper Legal Group, LLC

(57) ABSTRACT

A connecting device for constructing an arrangement composed of a plurality of loudspeaker boxes hanging beneath one another comprises a length-adjustable spacer rod which is designed to join together two loudspeaker boxes, which are adjacent in the arrangement, in a load-bearing manner. The length-adjustable spacer rod has a first element and a second element which can be fixed in at least two positions which are adjusted in terms of length relative to one another. In this case, at least one of the positions is secured with a closure which can be established and released by rotating the two elements relative to one another.

20 Claims, 5 Drawing Sheets

(56) References Cited

U.S. PATENT DOCUMENTS

| | | | | |
|---|---|---|---|---|
| 9,432,757 | B2 * | 8/2016 | Faranda | H04R 1/026 |
| 2005/0008165 | A1 | 1/2005 | Sack et al. | |
| 2006/0210095 | A1 * | 9/2006 | Monitto | H04R 1/028<br>381/87 |
| 2012/0189420 | A1 * | 7/2012 | Kemper | H04R 1/026<br>414/800 |
| 2013/0240288 | A1 * | 9/2013 | Givre | H04R 1/026<br>181/199 |
| 2014/0205126 | A1 | 7/2014 | Faranda et al. | |
| 2014/0301580 | A1 * | 10/2014 | Andrews | H04R 1/026<br>381/182 |
| 2018/0109859 | A1 * | 4/2018 | Haan | H04R 1/026 |

FOREIGN PATENT DOCUMENTS

| | | | |
|---|---|---|---|
| DE | 20006335 | U1 | 4/2000 |
| DE | 10039740 | C1 | 12/2001 |
| DE | 202011000262 | U1 | 5/2011 |
| DE | 102012110648 | A1 | 5/2014 |

* cited by examiner

CONNECTING DEVICE FOR LOUDSPEAKER BOXES, AND ARRANGEMENT OF LOUDSPEAKER BOXES HANGING BENEATH ONE ANOTHER

RELATED APPLICATIONS

The instant application claims priority to German Patent Application 102019111314.8, filed on May 2, 2019, which is incorporated herein by reference.

TECHNICAL FIELD

The invention relates to a connecting device for constructing an arrangement composed of a plurality of loudspeaker boxes hanging beneath one another, and also to an arrangement composed of a plurality of loudspeaker boxes hanging beneath one another.

BACKGROUND

For sound irradiation of relatively large audience areas inclosed spaces or in open spaces, loudspeaker arrangements which are constructed from loudspeaker boxes hanging beneath one another are employed. These loudspeaker arrangements are also referred to as line arrays.

For the optimal sound irradiation of the audience area, a suitable curvature of the line array has to be produced. In order to maintain a closed front of the curved line array, said front being advantageous in terms of acoustics, the loudspeaker housings are connected to one another in a rotatable manner at their front side and are of trapezoidal shape. This makes it possible to set the desired intermediate angles ("splay") between the housings (loudspeaker boxes) by way of length-adjustable connecting devices at the rear sides of the housings.

The setting range of the intermediate angles often lies between 0° and a maximum angle of between 7° and 15°. The need for an acoustic coupling of the wavefronts of the loudspeaker boxes is the reason for the limitation to a maximum angle. Larger intermediate angles would allow a gap to arise in the radiation characteristic at high frequencies. The maximum angle depends on the height of the line array module (that is to say the loudspeaker box) and the length of the wavefront segment emitted thereby. Tall modules (long emitters) generate high directivity and permit fewer intermediate angles. The maximum intermediate angle typically also reflects in the shape of the housing.

Relatively large intermediate angles are in particular possible if the wavefronts of the loudspeaker boxes are pre-curved. A precurvature of the wavefronts makes it possible to attain a greater vertical coverage with fewer loudspeaker boxes than with the customary line arrays having relatively flat wavefronts.

In the case of relatively large maximum intermediate angles and a correspondingly large intermediate angle range, the known connecting devices can often no longer be employed between the loudspeaker boxes, since they cannot cope with the increasing tilt between the housing rear walls or cannot be realized with sufficient length. There is also not enough space on the housing rear wall for such long connecting devices to be accommodated. In addition, it should be noted that the connecting devices in the hanging loudspeaker arrangement have to meet high safety requirements and are intended to allow for short installation and uninstallation times for the construction and dismantling works of loudspeaker arrangements of this kind.

Hence, it is desired to provide a connecting device for constructing an arrangement composed of a plurality of loudspeaker boxes hanging beneath one another, said connecting device also being employable for loudspeaker arrangements with relatively large intermediate angle ranges and in particular permitting simple, practicable and reliable installation and uninstallation of the loudspeaker arrangement. Furthermore, the disclosure is aimed at providing an arrangement composed of a plurality of loudspeaker boxes hanging beneath one another which can be joined together at relatively large intermediate angles.

SUMMARY

According to an aspect of the disclosure, a connecting device comprises a length-adjustable spacer rod which is designed to join together two loudspeaker boxes which are adjacent in the arrangement in a load-bearing manner. The length-adjustable spacer rod has a first element and a second element which can be fixed in at least two positions which are adjusted in terms of length relative to one another. At least one of the positions is secured with a closure, which can be established and released by rotating the two elements relative to one another.

The multi-element construction of the length-adjustable spacer rod makes it possible to realize a relatively large setting interval between the positions of the spacer rod. At least one of the at least two positions can be established and released by means of the closure in a simple manner—namely by rotating the two elements. In particular, the mechanism according to the disclosure thus makes it possible to also predefine large intermediate angles between loudspeaker boxes in a simple manner, to lock them in a mechanically secure manner, and to release the locking action again in a simple manner.

It goes without saying that also both or further length-adjusted positions can established and released with a closure of the described type.

According to another aspect of the disclosure, an arrangement constructed from a plurality of loudspeaker boxes hanging beneath one another comprises at least two loudspeaker boxes arranged beneath one another which are, in particular, connected to one another in the front region by way of an articulated connection and which are connected at the rear side by way of at least one connecting device of the type described above.

In this way, the advantages mentioned (in particular large intermediate angle and/or the ability to join the loudspeaker boxes together in a simple and secure manner) are ensured.

BRIEF DESCRIPTION OF THE DRAWINGS

The invention will be explained in more detail below on the basis of embodiments with reference to the drawings. Identical or similar parts are denoted by identical reference signs in the drawings. The drawings are to scale, that is to say, within a drawing, dimensions and dimension ratios can be gathered in exemplary fashion from the illustration.

DETAILED DESCRIPTION

Figure 1:
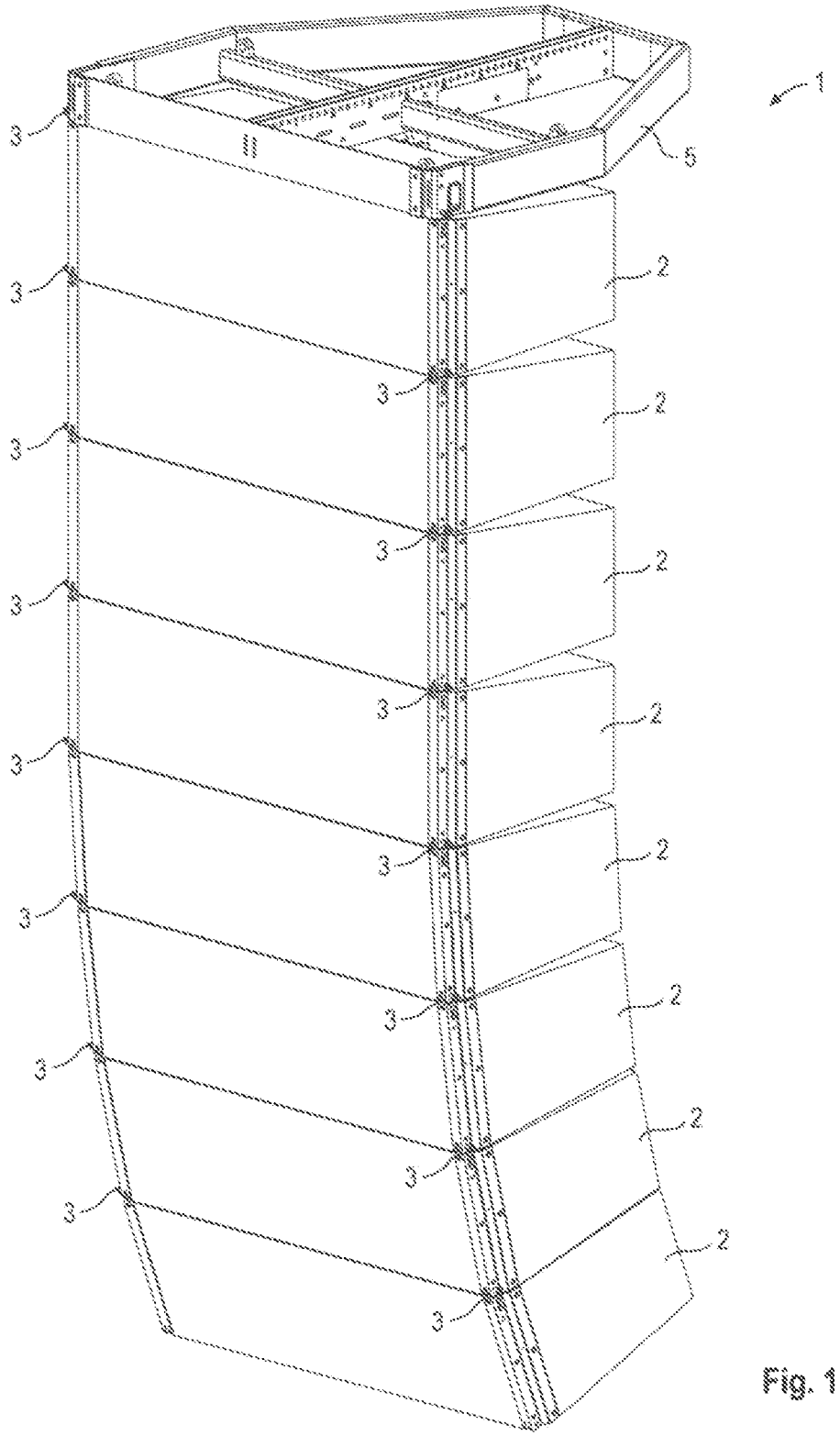
FIG. 1 is a perspective view of a line array having a flying frame and loudspeaker boxes suspended therefrom.

According to an example, the closure can for example be a bayonet closure. A mechanical connection which can be established and released rapidly is made possible by a bayonet closure, said mechanical connection being able to be formed by way of a pushing/rotating movement or a pulling/rotating movement, and being able to be canceled (released) by way of a counter-rotating/pulling movement or counter-rotating/pushing movement, respectively.

According to an example, the connecting device can be formed such that rotation of the two elements relative to one another is precluded in the case of joined-together loudspeaker boxes. This measure significantly increases the reliability of the joined-together connection. In particular, no anti-rotation securing means or the like are required to rule out unintentional release of the two elements from the position or positions in a guaranteed manner.

According to an example, the first element of the spacer rod can comprise a hollow rod and the second element of the spacer rod can comprise an inner rod which can be displaced in the hollow rod. The displaceability of these two elements makes it possible to achieve comparatively large setting intervals between the positions.

According to an example, the connecting device can further comprise a fastening rail which can be mounted on a loudspeaker box. In this case, the length of the fastening rail can be shorter than the length of the spacer rod in the position set to maximum length. The spacer rod set to maximum length (that is to say with maximum telescoping) can thus achieve a relatively long length compared with the dimensioning of the fastening rail, as a result of which correspondingly large intermediate angles can be set between the loudspeaker boxes.

The fastening rail can have a setting grid, in particular a hole grid, as a result of which further setting intervals between the loudspeaker boxes are made possible.

For the coupling of the spacer rod to the fastening rail, various solutions are possible in principle: According to a first embodiment, the first element of the connecting device can be fastened to an articulation point of the fastening rail in a rotatable manner. By contrast, in a second embodiment, the second element of the connecting device can be fastened to an articulation point of the fastening rail in a rotatable manner.

If the first element is fastened to the articulation point of the fastening rail in a rotatable manner, the second element of an adjacent connecting device can be configured to be fixed at a setting position which can be predefined in a variable manner by way of the setting grid. Otherwise, if the second element is fastened to the articulation point of the fastening rail in a rotatable manner, the first element of an adjacent connecting device can be configured to be fixed at a setting position which can be predefined in a variable manner by way of the setting grid.

In both embodiments, the position of the articulation point on the fastening rail can be structurally fixedly predefined, that is to say the respective (first or second) element can be anchored to the fastening rail in a rotatable but positionally fixed manner (that is to say without adjustability).

Both solutions make it possible to set the intermediate angle of adjacent loudspeaker boxes in two different ways, namely, on the one hand, by way of the length-adjustable spacer rod and, on the other hand, by way of the variable setting positions on the setting grid (for example hole grid) of the fastening rail. By combining these setting possibilities, it is possible to obtain a large setting range (corresponding to a large intermediate angle range) with a comparatively fine setting grid interval.

Provision can be made for the two elements to need to be rotated by equal to or greater than 90° or 180° or 270° in order to release the closure.

Furthermore, provision can be made for the length-adjustable spacer rod to be designed to transmit thrust forces. In this way, certain construction variants of the arrangement composed of loudspeaker boxes ("line array") are facilitated or made possible in the first place.

The length of the rear sides of the loudspeaker boxes in the hanging direction can be shorter than the length of the spacer rod in the position set to maximum length. On account of the ability to adjust the spacer rod in terms of length into the position of lesser (or minimum) length, it is nevertheless possible to ensure that the spacer rod can be stowed at the rear side of the loudspeaker box without protruding.

In the arrangement composed of a plurality of loudspeaker boxes hanging beneath one another, provision can be made that by means of the connecting device intermediate angles between the loudspeaker boxes of equal to or greater than 20° or 25° or 30° or 35° or 40° can be set.

FIG. 1 shows a linear loudspeaker arrangement 1 which is also referred to in the art as a line array. The loudspeaker arrangement 1 comprises a plurality of loudspeaker boxes 2 hanging beneath one another. The loudspeaker boxes 2 can be hung on a flying frame 5. In the front region, the loudspeaker boxes 2 can adjoin one another directly, that is to say forma substantially closed front surface.

By way of example, the loudspeaker boxes 2 can be connected to one another in the front region by way of articulated connecting elements 3. The articulated connecting elements 3 each define an axis of rotation between adjoining loudspeaker boxes 2. The intermediate angle ("splay") is typically set in the rear region of the loudspeaker boxes 2 by way of connecting devices which are not visible in FIG. 1. The intermediate angle of adjacent loudspeaker boxes 2 corresponds to the angle between the axes of the main radiation directions of adjacent loudspeaker boxes 2.

As can be seen in FIG. 1, the intermediate angle between the loudspeaker boxes 2 can vary. A maximum intermediate angle is given by abutment of the housing surfaces of adjacent loudspeaker boxes 2, that is to say the settable intermediate angle is limited by the conicity of the housing shape of the loudspeaker boxes 2.

Figure 2:
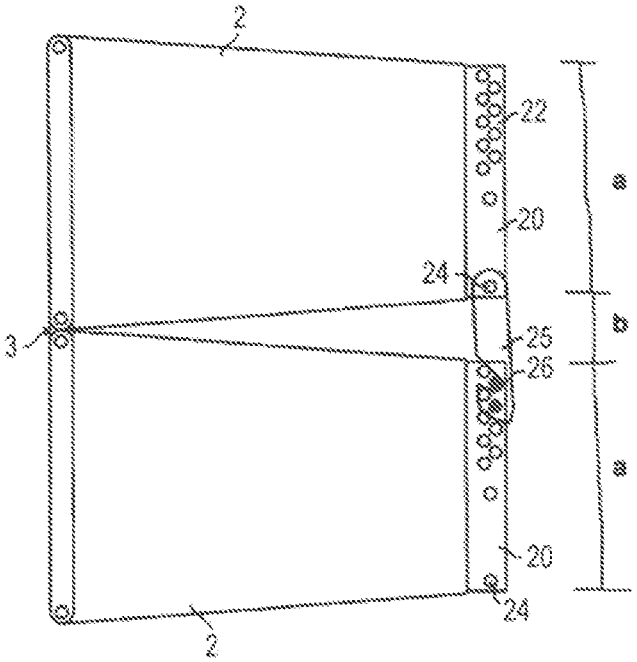
FIG. 2 is a cross-sectional illustration of two loudspeaker boxes having a latched and secured connecting device according to conventional art.

FIG. 2 shows a side view of two loudspeaker boxes 2 oriented parallel according to a conventional solution for setting the intermediate angle. The rear sides of the loudspeaker boxes 2 are equipped with a profile element 20 which is provided in the upper region thereof with a hole grid 22 and in the lower region thereof with a rotary suspension 24 for a latching hook 25. By selecting a suitable hole in the hole grid 22 for a plug-in bolt 26, which is engaged around by the latching hook 25 of the connecting device arranged thereabove, it is possible to preselect and set the different intermediate angles.

In known loudspeaker arrangements 1, the housing height a available for the hole grid on the housing rear side is greater than the required adjustment range b and therefore sufficient.

In addition, the housing height a is also greater than the length of the latching hook 25. Thus, there is always enough space on the housing rear side to stow the latching hook 25—for example when transporting the loudspeaker boxes 2—on the housing rear side (by folding said latching hook upward into a slot opening in the profile element 20).

Figure 3:
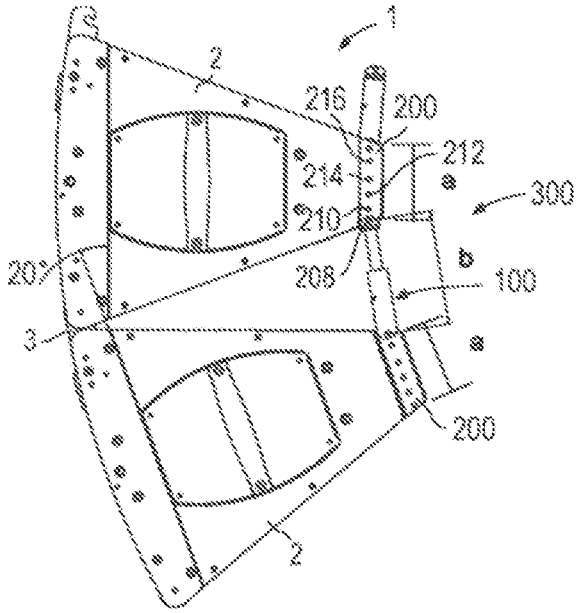
FIG. 3 is a cross-sectional illustration of two loudspeaker boxes having an exemplary connecting device according to various embodiments.

FIG. 3 shows in exemplary fashion two adjacent loudspeaker boxes 2 of a loudspeaker arrangement 1, with which radiation can be performed over an extended angle range. As mentioned, this can be made possible, for example, by pre-curving the wavefronts of the individual loudspeaker boxes 2 in order to avoid gaps in the sound irradiation field in spite of relatively large intermediate angles. By way of example, a precurvature of the wavefronts in the range of between 0°-30° or more can be provided for greater vertical sound coverage with regard to a given number of loudspeaker boxes 2. The loudspeaker boxes 2 can be arranged in a line array loudspeaker arrangement 1 as shown in FIG. 1.

FIG. 3 makes it clear that in order to set a larger intermediate angle the conicity of the loudspeaker boxes 2 has been increased in comparison with known line arrays (see FIG. 2). The housing height a at the rear side of the loudspeaker box 2 can be the same size as, or smaller than, the possible adjustment range b. In this case, the adjustment range b cannot be covered with a hole grid on a rear-side fastening rail 200 of the loudspeaker box 2.

An exemplary connecting device 300 comprises a length-adjustable spacer rod 100. The ability to adjust the spacer rod 100 in terms of length into at least two predefined setting lengths (stages) makes it possible for a partial range of the angle range available for radiation to be covered in each length setting of the spacer rod 100. If there is a further capacity for setting, for example by means of a setting grid (for example a hole grid) in the region of the rear side of the loudspeaker box 2, identical or different grid points (for example holes 208, 210, 212, 214, 216) can be used for the respective length settings of the spacer rod 100.

FIGS. 4A to 4E show the connecting device 300 with the length-adjustable spacer rod 100 in different positions. In addition, the connecting device 300 can comprise the fastening rail 200, which is attached, for example, to the rear wall of the loudspeaker box 2. The attachment of the fastening rail 200 to the housing rear side can be positionally fixed, that is to say not adjustable.

The fastening rail 200 can form the setting grid, for example in the form of the hole grid having holes 208, 210, 212, 214, 216. The setting grid makes it possible to fix a spacer rod 100 of an adjacent connecting device at a setting position (given by the holes 208, 210, 212, 214, 216) which can be predefined in a variable manner by way of the setting grid. Furthermore, the fastening rail 200 can have an articulation point 218 at which the spacer rod 100 is attached to the fastening rail 200 in a rotatable manner.

The spacer rod 100 can be adjusted in terms of length. For this purpose, it can have a first element and a second element which can be displaced relative to one another. According to the exemplary embodiment shown here, the first element can be configured as, or comprise, a hollow rod 120 and the second element can be configured as, or comprise, an inner rod 140 which can be displaced in the hollow rod. However, according to a further exemplary embodiment, it is also possible for the first element to be provided as an inner rod and the second element to be provided as a hollow rod (not shown in the figures). Features which are explained on the basis of the exemplary embodiment illustrated here can be applied analogously to said further exemplary embodiment.

Figures 4A, 4B, 4C, 4D, 4E:
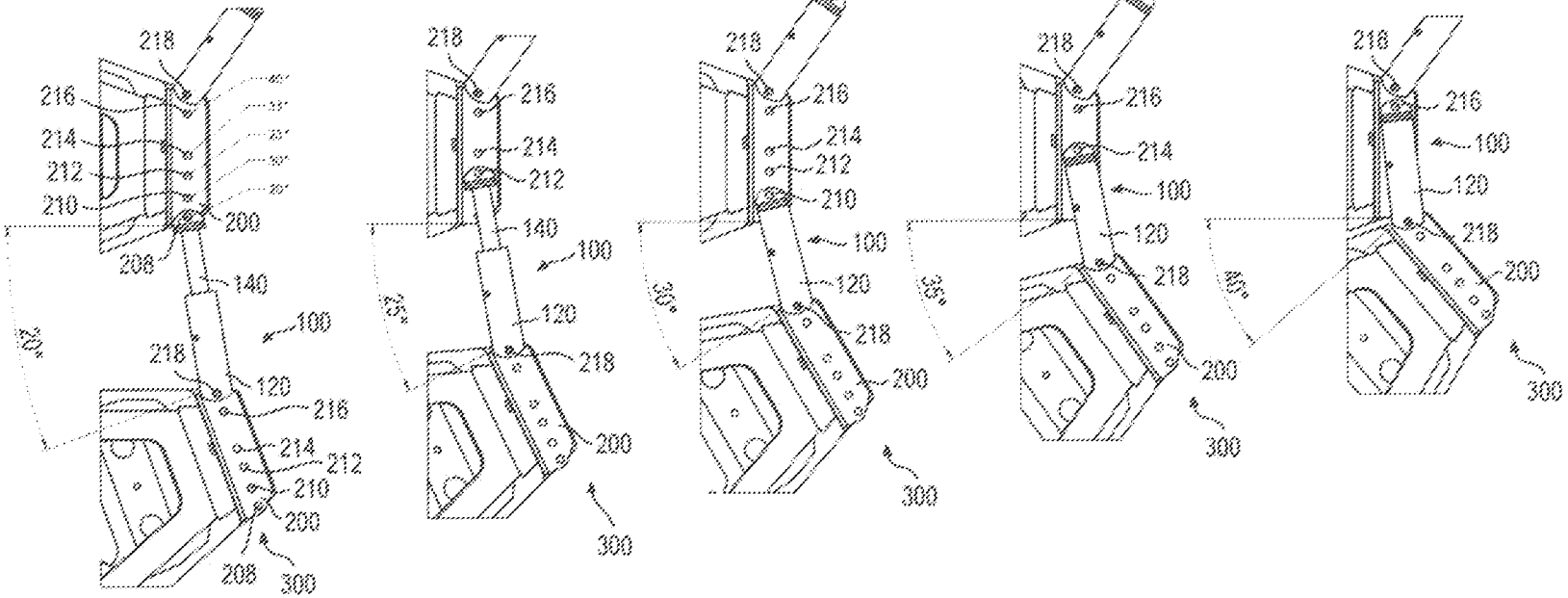
FIGS. 4A-E show positions of the connecting device for the realization of different intermediate angles between adjacent loudspeaker boxes.

FIGS. 4A to 4E show two positions of the spacer rod 100, as well as different attachment points of the second element (here inner rod 140) on the setting grid of the fastening rail 200. According to FIG. 4A, an intermediate angle of for example 20° is set by the spacer rod 100 being in the position which is adjusted to the maximum in terms of length and the second element being fixed to the lowermost attachment point (for example hole 208) of the setting grid on the fastening rail 200. FIG. 4B shows the setting of an intermediate angle of for example 25°, in that the second element of the maximally telescoped spacer rod 100 is attached to a further upwardly situated attachment point (for example hole 212) of the setting grid.

In FIGS. 4C to 4E, the spacer rod 100 is in its retracted position and is thus shorter in relation to the position shown in FIGS. 4A and 4B, with different intermediate angles (for example 30° or 35° or 40°) being obtained by attaching the second element to different attachment points (for example holes 210 or 214 or 216 respectively) on the setting grid of the fastening rail 200.

It is evident that, by combining different setting positions on the setting grid and lengths of the spacer rod 100, a multiplicity of intermediate angles can be realized, such that both a large setting range and fine division of intermediate angles are possible.

The length of the spacer rod 100 in the completely retracted state, that is to say in the position set to minimum length, can be the same as, or (somewhat) shorter than, the housing height a and/or the length of the fastening rail 200. As a result, it is possible for the spacer rod 100 to be stowed at the rear side of the respective loudspeaker box 2 (here on the lower loudspeaker box 2) without protruding by folding said spacer rod back.

Figure 5:
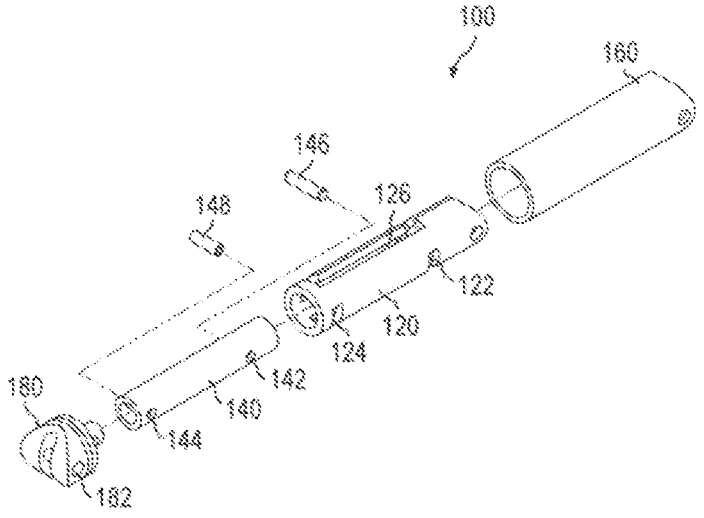
FIG. 5 is an exploded illustration of an exemplary connecting device.
Figure 6:
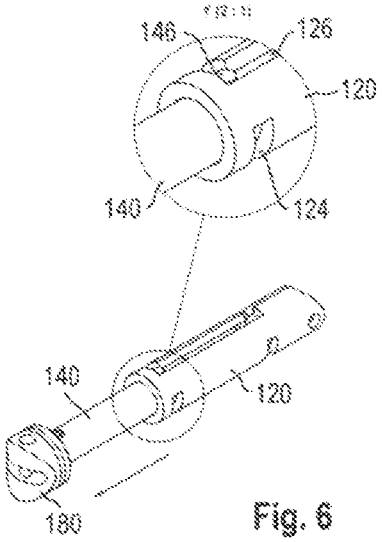
FIG. 6 is an exemplary connecting device in an extended and open position.
Figure 7:
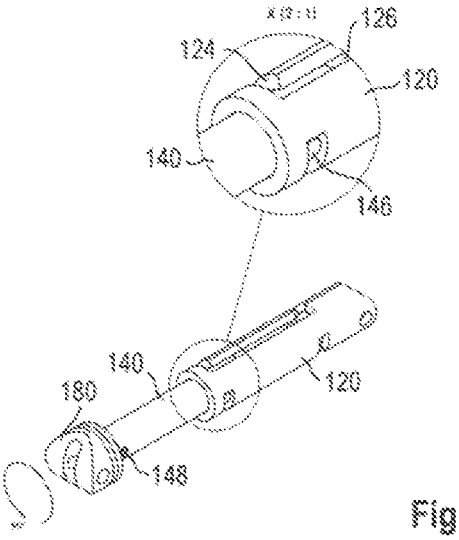
FIG. 7 is the connecting device of FIG. 6 in an extended and closed position.

FIGS. 5, 6 and 7 show a possible exemplary embodiment of the spacer rod 100. In the exemplary embodiment illustrated, the spacer rod 100 can be brought into two positions which differ in terms of length adjustment. However, it is also possible for more than two such positions to be realized, with the features described below for the two positions optionally also being able to be applied to the further positions (not illustrated).

The first element of the spacer rod 100, said element being configured below for example and without restriction of generality as a hollow rod 120, can be cylindrical and have an inner diameter which corresponds, apart from a small movement gap, to the outer diameter of the second element, which is configured below, without restriction of generality, as a cylindrical inner rod 140. The first element can thus be used as a guide cylinder for the second element. The two elements can be coaxial.

The hollow rod 120 can be provided, for example, with a slot which, in the manner of a slotted guide, predefines the movement path and in particular the different positions of the inner rod 140 in the hollow rod 120. As is evident in the Figures, the two positions can be defined by circumferential slots 122, 124 running peripherally over a circular segment in the hollow rod 120. The circumferential slots 122, 124 can be connected to one another by a longitudinal slot 126 in the hollow rod 120.

The hollow rod 120 can be surrounded by an outer cylinder 160 in order to make it easier for the operator to handle the connecting device 300 and/or to protect the mechanism thereof against external influences. The (optional) cylinder 160 can be connected to the hollow rod 120 in a rotationally fixed manner, for example by being attached together with the hollow rod 120 to the articulation point 218 of the fastening rail 200 (see for example FIGS. 4A-4E, in which the hollow rod 120 is likewise surrounded by the outer cylinder 160, and the hollow rod 120 and the cylinder 160 are jointly anchored to the (lower) fastening rail 200 at the articulation point 218).

At the free end of the inner rod 140, a head piece 180 can be fixedly attached, which makes it possible to fasten the inner rod 140 to the fastening rail 200. For this purpose, the head piece 180 can be provided with a through-hole 182, by way of which the head piece 180 can be fastened for example by means of a bolt (not illustrated) to an attachment point of the setting grid (see FIGS. 4A to 4E) on the fastening rail 200. The head piece 180 can also be embodied integrally with the inner rod 140.

FIG. 5 further shows that the inner rod 140 can be provided close to the two ends thereof with a transverse hole 142, 144, respectively. Pins 146 and 148, respectively, can be pushed through the transverse holes 142, 144 and anchored in the transverse holes 142, 144. The pin length of the first pin 146 can for example correspond substantially to the outer diameter of the hollow rod 120, such that the inner rod 140 can be displaced and rotated along the slots 122, 126, 124 in the hollow rod. The (optional) second pin 148 is used to fasten the head piece 180 to the inner rod 140 (which can optionally likewise be realized as a hollow rod). The second pin 148 can have a length which corresponds substantially to the outer diameter of the inner rod 140. Said second pin may for example be embodied as a spring pin.

The Figures illustrate that both the retracted position (here defined by the first pin 146 being in the circumferential slot 122) and the extended position (here defined by the first pin 146 being in the circumferential slot 124) of the spacer rod 100 are realized by rotary closures. In the example illustrated here, the rotary closures are embodied as bayonet closures, that is to say the different length settings of the spacer rod 100 are locked by rotating the inner rod 140 relative to the hollow rod 120 and are released again by rotation in the opposite direction.

It is not absolutely necessary for the two positions to be able to be set by rotating the two elements relative to one another. It is for example also conceivable for one of the two positions to be realized merely by a stop, with then an (optional) securing of this connection (which cannot be established and released by way of rotation) can be implemented by way of an alternative measure, for example locking by means of a locking bolt.

FIG. 6 shows the length-adjustable spacer rod 100 in the maximally extended (that is to say telescoped) and open position. The closure between the hollow rod 120 and the inner rod 140 is established as a result of axial rotation by for example at least 90° or 180° or 270°, see FIG. 7.

On account of the circumferential slots 122, 124, the spacer rod 100 is rigid in both positions, that is to say is configured both to absorb tensile forces and to transmit thrust forces. If the extended position is predefined by a stop without a circumferential slot 124, the spacer rod 100 is suitable merely for absorbing tensile forces.

Figure 8A:
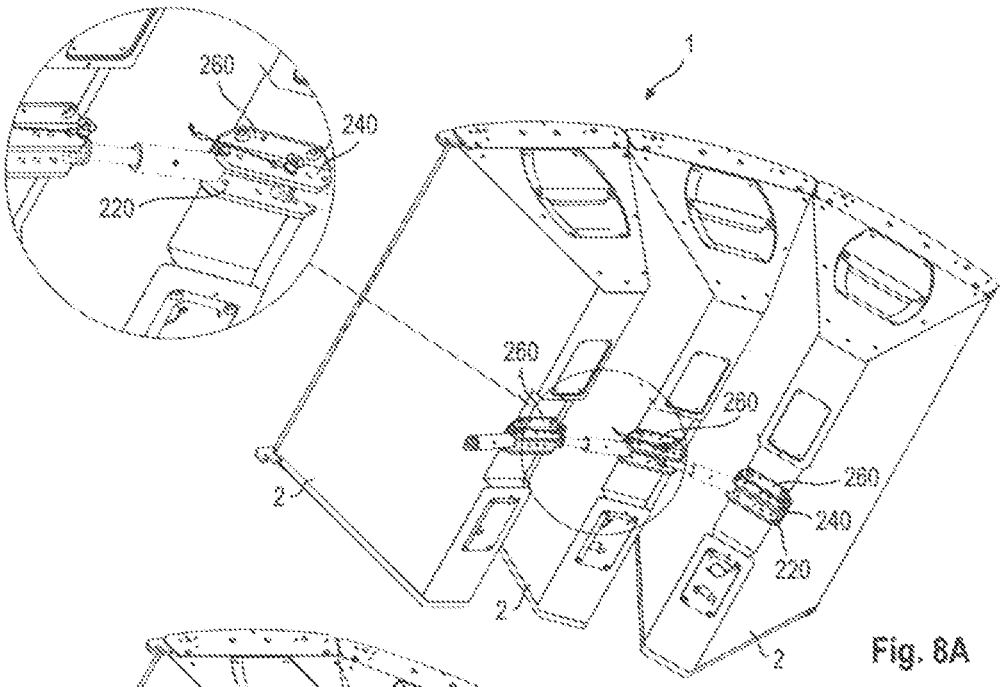
FIGS. 8A-B are perspective rear views of joined-together loudspeaker boxes according to exemplary embodiments, and a respective enlarged detail of the rear views.
Figure 8B:
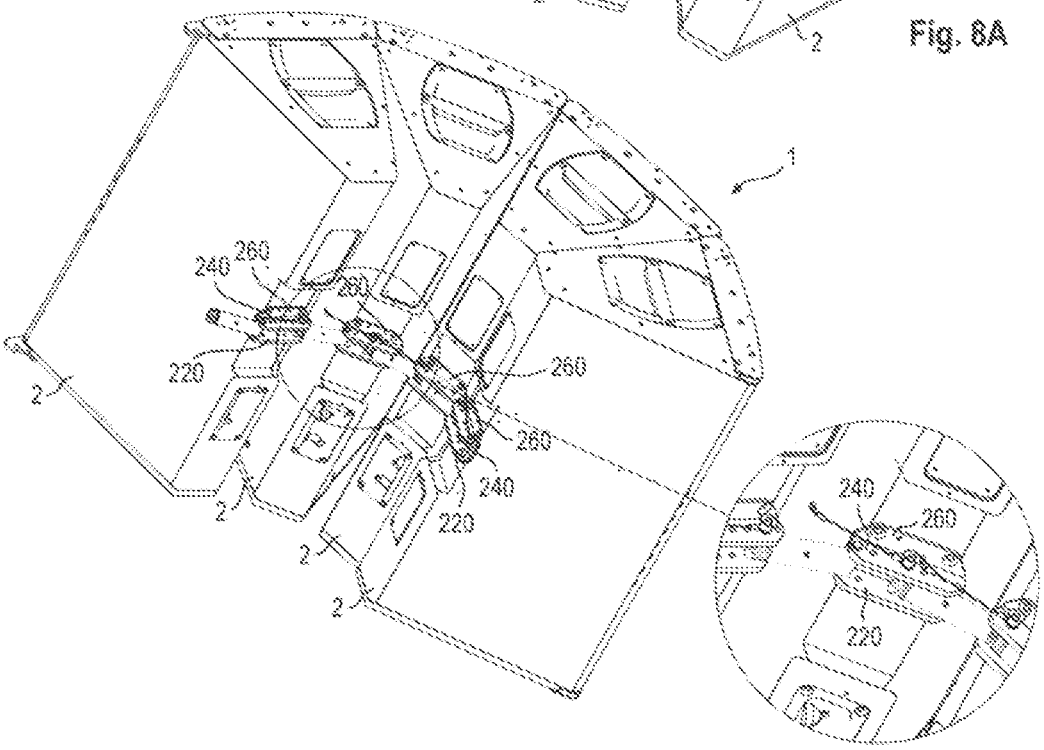

FIGS. 8A and 8B show perspective views of various construction variants of a loudspeaker arrangement 1. In the Figures, it is evident that the fastening rail 200 can be embodied, for example, as a double profile element having two longitudinal profiles 220, 240. The two longitudinal profiles 220, 240 can be fixedly connected to a baseplate 260 which, for its part, is fixedly anchored to the rear wall of the loudspeaker box 2. The hole grid can be realized in both longitudinal profiles 220, 240. The connecting devices 300 are attached in the central region of the rear wall of the loudspeaker boxes 2, as a result of which a 3-point suspension can be realized, for example.

FIG. 8A shows an arrangement in which the loudspeaker boxes 2, with spacer rods 100 set to maximum length, are oriented at increasing intermediate angles from right to left. FIG. 8B illustrates another setting of the connecting device 300 in which the spacer rod 100 is always located in its position of minimum length (that is to say in the retracted state) and the intermediate angle variations are achieved solely by way of the hole grid.

The invention claimed is:

1. A connecting device for constructing an arrangement of a plurality of loudspeaker boxes hanging beneath one another, the connecting device comprising:

a length-adjustable spacer rod configured to join together two loudspeaker boxes which are adjacent in the arrangement in a load-bearing manner, the length-adjustable spacer rod comprising:

a first element, and a second element, wherein:

the first element and the second element are configured to be fixed in at least two positions which are adjusted in terms of length relative to one another, at least one of the at least two positions is secured with a closure configured to be locked and released by rotating the first element and the second element relative to one another, wherein, when the closure is locked, the closure is rigid to absorb tensile forces and to transmit thrust forces, and the closure is a bayonet closure configured to lock a rigid length setting of the length-adjustable spacer rod by rotating the second element relative to the first element in a first direction and configured to release the rigid length setting of the length-adjustable spacer rod by rotating the second element relative to the first element in a second direction opposite to the first direction.

2. The connecting device of claim 1, wherein a rotation of the first element and the second element relative to one another is precluded in the case of joined-together loudspeaker boxes.

3. The connecting device of claim 1, wherein:

the first element comprises a hollow rod comprising a circumferential slot and a longitudinal slot, the circumferential slot and the longitudinal slot being connected with each other, and the second element comprises an inner rod configured to be displaced in the hollow rod along the longitudinal slot and to be rotated in the hollow rod along the circumferential slot by virtue of a pin mounted to the inner rod configured to engage with the circumferential slot and the longitudinal slot, wherein, when the pin is in the circumferential slot, the closure is locked.

4. The connecting device of claim 1, further comprising:

a fastening rail configured to be mounted on a loudspeaker box.

5. The connecting device of claim 4, wherein a length of the fastening rail is shorter than a length of the length-adjustable spacer rod when the length-adjustable spacer rod is set to a position in which the length-adjustable spacer rod has a maximum length.

6. The connecting device of claim 4, wherein the fastening rail comprises a setting grid.

7. The connecting device of claim 6, wherein either the first element or the second element is fastened to an articulation point of the fastening rail in a rotatable manner, a position of the articulation point on the fastening rail being fixedly predefined.

8. The connecting device of claim 7, wherein:

a second element of an adjacent connecting device is configured to be fixed at a setting position which can be predefined in a variable manner by way of the setting grid when the first element of the connecting device is fastened to the articulation point of the fastening rail in the rotatable manner, or a first element of an adjacent connecting device is configured to be fixed at a setting position which can be predefined in a variable manner by way of the setting grid when the second element of the connecting device is fastened to the articulation point of the fastening rail in the rotatable manner.

9. The connecting device of claim 1, wherein the first element and the second element are required to be rotated by equal to or greater than 90° in order to release the closure.

10. The connecting device of claim 1, wherein the length-adjustable spacer rod is configured to transmit thrust forces.

11. An arrangement of a plurality of loudspeaker boxes hanging beneath one another, comprising:

at least two loudspeaker boxes arranged beneath one another, wherein the at least two loudspeaker boxes are connected to one another in a front region by way of an articulated connection and are connected at a rear side by at least one connecting device as claimed in claim 1.

12. The arrangement of claim 11, wherein a length of the rear sides of the at least two loudspeaker boxes in a hanging direction is shorter than a length of the length-adjustable spacer rod when the length-adjustable spacer rod is set to a position in which the length-adjustable spacer rod has a maximum length.

13. The arrangement of claim 11, wherein the at least one connecting device is configured to set intermediate angles between the at least two loudspeaker boxes of equal to or greater than 20°.

14. The connecting device of claim 6, wherein the setting grid is a hole grid.

15. The connecting device of claim 1, wherein the first element and the second element are required to be rotated by equal to or greater than 180° in order to release the closure.

16. The connecting device of claim 1, wherein the first element and the second element are required to be rotated by equal to or greater than 270° in order to release the closure.

17. The arrangement of claim 11, wherein the at least one connecting device is configured to set intermediate angles between the at least two loudspeaker boxes of equal to or greater than 25°.

18. The arrangement of claim 11, wherein the at least one connecting device is configured to set intermediate angles between the at least two loudspeaker boxes of equal to or greater than 30°.

19. A connecting device for constructing an arrangement of a plurality of loudspeaker boxes hanging beneath one another, the connecting device comprising:

a length-adjustable spacer rod configured to join together two loudspeaker boxes which are adjacent in the arrangement in a load-bearing manner, the length-adjustable spacer rod comprising:

a first element, and a second element, wherein:

the first element and the second element are configured to be fixed in at least two positions which are adjusted in terms of length relative to one another, at least one of the at least two positions is secured with a closure configured to be locked and released by rotating the first element and the second element relative to one another, wherein, when the closure is locked, the closure is rigid to absorb tensile forces and to transmit thrust forces, the first element comprises a hollow rod comprising a circumferential slot and a longitudinal slot, the circumferential slot and the longitudinal slot being connected with each other, and the second element comprises an inner rod configured to be displaced in the hollow rod along the longitudinal slot and to be rotated in the hollow rod along the circumferential slot by virtue of a pin mounted to the inner rod configured to engage with the circumferential slot and the longitudinal slot, wherein, when the pin is in the circumferential slot, the closure is locked.

20. A connecting device for constructing an arrangement of a plurality of loudspeaker boxes hanging beneath one another, the connecting device comprising:

a length-adjustable spacer rod configured to join together two loudspeaker boxes which are adjacent in the arrangement in a load-bearing manner, the length-adjustable spacer rod comprising:

a first element, and a second element, wherein:

the first element and the second element are configured to be fixed in at least two positions which are adjusted in terms of length relative to one another, and at least one of the at least two positions is secured with a closure configured to be locked and released by rotating the first element and the second element relative to one another, wherein, when the closure is locked, the closure is rigid to absorb tensile forces and to transmit thrust forces; and a fastening rail configured to be mounted on a loudspeaker box, wherein:

the fastening rail comprises a setting grid, either the first element or the second element is fastened to an articulation point of the fastening rail in a rotatable manner, a position of the articulation point on the fastening rail being fixedly predefined, and a second element of an adjacent connecting device is configured to be fixed at a setting position which can be predefined in a variable manner by way of the setting grid when the first element of the connecting device is fastened to the articulation point of the fastening rail in the rotatable manner, or a first element of an adjacent connecting device is configured to be fixed at a setting position which can be predefined in a variable manner by way of the setting grid when the second element of the connecting device is fastened to the articulation point of the fastening rail in the rotatable manner.

* * * * *